US005832833A

United States Patent [19]

Burgio

[11] Patent Number: 5,832,833

[45] **Date of Patent: *Nov. 10, 1998**

[54] APPARATUS AND METHOD FOR DRYING A SUBSTRATE PRINTED ON A MULTI-STAND OFFSET PRESS

[76] Inventor: Joseph Thomas Burgio, 669 Kelly Brewer Rd., Leasburg, N.C. 27291

[ * ] Notice: The term of this patent shall not extend beyond the expiration date of Pat. No. 5,727,472.

[21] Appl. No.: 685,218

[22] Filed: Jul. 23, 1996

Related U.S. Application Data

[63] Continuation-in-part of Ser. No. 507,046, Jul. 25, 1995, Pat. No. 5,727,472.

[51] Int. Cl.[6] ..... B41F 35/00

[52] U.S. Cl. ..... 101/424.1; 101/487

[58] Field of Search ..... 101/487, 480, 101/483, 424.1, 424.2, 488

[56] References Cited

U.S. PATENT DOCUMENTS

| | | | |
|---|---|---|---|
| 2,174,864 | 10/1939 | Barber | 101/229 |
| 2,288,617 | 7/1942 | Friden | 91/16 |
| 2,359,825 | 10/1944 | Campbell | 101/115 |
| 3,121,642 | 2/1964 | Biskup | 117/15 |
| 3,221,646 | 12/1965 | Hardy, Jr. et al. | 101/115 |
| 3,900,959 | 8/1975 | Breschi et al. | 8/75 |
| 4,312,137 | 1/1982 | Johne et al. | 34/43 |
| 4,501,072 | 2/1985 | Jacobi | 34/34 |
| 4,756,091 | 7/1988 | Van Denend | 3/34 |
| 4,809,608 | 3/1989 | Wolnick et al. | 101/416.1 |
| 4,811,493 | 3/1989 | Burgio, Jr. | 34/4 |
| 4,841,903 | 6/1989 | Bird | 118/46 |
| 4,939,992 | 7/1990 | Bird | 101/183 |
| 4,983,852 | 1/1991 | Burgio, Jr. | 250/504 R |
| 5,115,741 | 5/1992 | Rodi | 101/424.1 |
| 5,263,265 | 11/1993 | Melgaard | 34/17 |
| 5,265,536 | 11/1993 | Millard | 101/424.2 |
| 5,502,788 | 3/1996 | Platsch | 392/424 |
| 5,537,925 | 7/1996 | Secor et al. | 101/424.1 |
| 5,540,152 | 7/1996 | DeMoore | 101/483 |
| 5,606,914 | 3/1997 | Borgardt | 101/424.1 |
| 5,619,927 | 4/1997 | Winheim | 101/487 |

FOREIGN PATENT DOCUMENTS

| | | | |
|---|---|---|---|
| 0378826 | 7/1990 | European Pat. Off. . | |
| 0 545 862 A1 | 6/1993 | European Pat. Off. . | |
| 2323792 | 11/1974 | Germany . | |
| 3606005 | 9/1986 | Germany . | |
| 2 276 123 | 9/1994 | United Kingdom | 34/17 |

OTHER PUBLICATIONS

Aradiant, Design Features & Technical Concepts Brochure, Copyright 1993.

*Primary Examiner*—Edgar S. Burr
*Assistant Examiner*—Anthony H. Nguyen
*Attorney, Agent, or Firm*—Seidel, Gonda, Lavorgna & Monaco, PC

[57] ABSTRACT

Apparatus and a method for printing and drying layers of ink applied to the surface of a continuous substrate in a multi-stand offset press comprising a plurality of stands, each having a printing portion for the application of a layer of ink to the substrate as it passes through the stand, and a drying assembly mounted after and adjacent each printing stand portion and adjacent the substrate for drying the substrate and layer of ink thereon after passage therefrom. The drying assembly comprises an emitter-cooler that radiates energy toward the ink-layered substrate and gas duct that directs air toward the ink-layered substrate to dry the substrate and layer of ink thereon contributing to further drying thereof and evaporation of water vapor and solvents arising therefrom.

15 Claims, 6 Drawing Sheets

APPARATUS AND METHOD FOR DRYING A SUBSTRATE PRINTED ON A MULTI-STAND OFFSET PRESS

CROSS REFERENCE TO RELATED APPLICATION

This application is a continuation-in-part of U.S. application Ser. No. 507,046 filed Jul. 25, 1995 now U.S. Pat. No. 5,727,472.

FIELD OF THE INVENTION

This invention relates to improved apparatus and method for drying sheets printed in a multi-stand offset press in a manner that the sheets may be discharged one on top of another, without the use of powders to prevent off-set or blocking, from the delivery end of the press. More particularly, the invention is applicable to apparatus and a method for radiant drying and gas scrubbing of the printed sheets within each stand of a multi-stand offset press, so that the sheets may be discharged from the press delivery end without the use of anti-offset powders, one upon another, without off-set or blocking. This invention further relates to improved apparatus and method for printing a continuous substrate in a multi-stand offset press and drying the printed substrate adjacent and following each stand.

BACKGROUND OF THE INVENTION

For a long time the demand for enhanced gloss print, increased production, and quicker turnaround for printers has been a dominant theme in commercial printing and packaging. Modern multi-stand, sheet-fed printing presses operate at such high speeds that the inks applied to the sheets of different materials do not adequately dry before being discharged onto sheet stacking equipment at the ends of the delivery ends of such presses. Such inadequate drying leads to a variety of problems, including set-off and/or blocking problems and gas ghosting. Set-off is a term which refers to the transfer of ink from the surface of a first printed sheet to the back of an immediately following sheet that falls on top of the first sheet. Blocking is a term which refers to the adhesion of several sheets of a stack due to the inadequately dried ink of at least some of the sheets sticking to the following adjacent sheets. Gas ghosting refers to the tendency of a back printed sheet which has an image printed on the bottom side that appears to have passed through onto the top side thereof.

There have been various methods and forms of apparatus proposed for dealing with the inadequate drying and throughput problems associated with offset press operations. One of the increasingly used solutions has been the use of ultraviolet inks and/or coatings and equipment applicable thereto. U.S. Pat. No. 4,983,852 to J. T. Burgio, Jr. describes a system and method of curing a photo-sensitive coating on a substrate by means of a reflector operated, in conjunction with a refrigerating system, within a controlled temperature range. Use of ultraviolet inks and related equipment is an acceptable way of dealing with the aforementioned inadequate drying problems. However, a large segment of commercial printers has resisted the use of such inks because of their expense, color matching problems, and negative operator perception.

An alternative to the use of ultraviolet inks has been the use of conventional inks that generally require the use of anti-offset powders between the printed sheets to prevent sticking. Such inks are dried with infra-red dryers, air systems, or a combination of both. While the primary function of ultra-violet inks is to reduce or eliminate spray powders, because of the differences in drying machinery, delivery designs and different printing presses, and specific characteristics of different inks, spray powders are not universally eliminated with conventional inks. Thus, except in a printing shop devoted exclusively to the use of ultra-violet inks and drying equipment, one of the biggest problems in any printing shop is due to the use of anti-offset powders. Such powders are discharged from dispensers positioned in the delivery ends of press housings onto printed sheets that are discharged onto sheet stackers located after the ends of such housings. Reportedly, only about twenty-five to thirty percent of such powders adhere to the undried inks of the printed sheets and the remainder remains airborne. The powders combine with lubricants and other materials used on the presses and have an extremely harsh effect on equipment. In addition, the powders simply float in the air and create havoc with clean printing results, requiring presses to be stopped for blanket washing, hickeys, etc., and constitute an environmental problem.

The original installations of infra-red offset drying systems were touted to eliminate the use of spray powders and increase the speed at which jobs could be further worked because of the rapid setting of the inks. Virtually every non-ultraviolet, multi-color press on the market today has an infra-red dryer. U.S. Pat. No. 4,811,493 to J. T. Burgio, Jr. describes an improved infra-red dryer-cooler apparatus in combination with a refrigeration system. The apparatus comprises a cooling plate, end blocks and a plurality of infra-red lamps extending between the end blocks, adjacent a reflective face of the cooling plate. The dryer-cooler apparatus is mounted in the delivery end of a printing press to cure or dry the ink on sheets passing beneath the lamps. Another approach to the drying of sheets in printing presses is described in U.S. Pat. No. 4,312,137 to Hans Johns, et al. which shows a radiant dryer positioned between two printing units to act upon a sheet carried by an impression roller.

Notwithstanding the claims made to date for infra-red drying systems, the fact remains that in today's printing environment the elimination of spray powders has not been achieved in conjunction with conventional inks with any measurable success. Water-based coatings have achieved a reduction in the use of spray powders in some instances, but there are still a great many jobs where no coating is desired, or if it is, the application of a coating to the entire sheet is not desired. In addition, the use of water-based coatings to eliminate spray powders adds a significant cost to printing a job. Consequently, anti-offset powders continue to be used in a majority of infra-red printing operations and the problems created by the use of such powders are dealt with in a variety of ways. U.S. Pat. No. 5,265,536 to J. S. Millard, describes a hood assembly for collecting and treating anti-offset powders arising from the operation of a multi-stand printing press. While the invention of such patent and those of many other patents are directed to apparatus and systems for collecting and treating anti-offset powders dispensed onto printed sheets in press delivery end housings, there appears to have been no commercially acceptable development which eliminates the use of such powders in many press operations.

Another type of offset printing press applies ink to the surface of a continuous substrate or web passing rapidly through the stands of a multi-stand press. Such a press, commonly referred to as a web press, feeds the substrate from a roll on an unwind stand, through a substrate tensioning system, a plurality of printing stands in which ink is applied to the continuously moving substrate, and then dries the coated surface of the substrate in a gas fired dryer spaced from the last printing stand, reduces the temperature of the heated substrate in a cooling unit, and passes the substrate to additional process equipment where it can be rewound onto a roll, cut into sheets, or folded. While there are certain types of printing jobs for which web presses offer certain advantages over sheet fed offset presses, the drying/cooling equipment positioned after the last printing stand is expensive from an investment viewpoint and costly to operate. Certain users of web press do not have drying/cooling equipment and are restricted to printing only simple work without significant amounts of color and at slower speeds.

OBJECTS OF THE INVENTION

An object of the present invention is to provide apparatus and a method for effectively drying printed sheets passing through a multi-stand offset press so that there is no requirement to dispense powders onto such sheets at the delivery end of the press to prevent set-off or blocking once such sheets are stacked one upon another or subsequent gas ghosting in the event such sheets are back printed. Back printing refers to the return of printed sheets to the feed end of a press for subsequent printing on the reverse side.

Another object of the invention is to provide apparatus of compact, simple, and inexpensive construction, of a size which can be adapted to existing and new offset printing presses without extensive design and manufacturing modifications, and that eliminates the requirement: (A) in a sheet fed press for use of an anti-offset powder system for dispensing powders onto sheets at the delivery end of a press to prevent set-off or blocking when such sheets are stacked one upon another, or subsequent gas ghosting in the event such sheets subsequently are back printed, (B) in a web press for dryer/cooler apparatus spaced after the last printing stand.

It is another object of this invention to provide a method of operating such apparatus which enables a press operator to utilize various sheet materials and conventional inks without resorting to the use: (A) in a sheet fed press of anti-set-off powders so that the problems resulting from the use of such powders are avoided with consequent economies of operation, or (B) in a web press of large dryer/cooler apparatus spaced after the last printing stand to heat dry the moving ink coated substrate and then cool it to reduce its temperature for further processing.

SUMMARY OF THE INVENTION

The present invention overcomes the problems and disadvantages associated with the use, at the delivery end of multi-stand, offset, sheet fed printing presses, of anti-offset powders dispensed onto printed sheets to deal with the inability of the ink printed thereon to adequately dry or cure before the sheets are stacked one upon another. More specifically, the apparatus comprises a sheet-fed printing press comprising: (A) a plurality of printing stands, each with a printing portion in which a layer of ink is applied to each sheet as it passes through each such stand and a drying assembly, comprising a gas wiping device and emitter-cooler unit, mounted after and adjacent each stand printing portion and adjacent the sheets passing rapidly therethrough; and (B) a delivery end, including a stacking device upon which the sheets are discharged one upon another. Radiant energy from emitters of the drying assembly dries the layer of ink upon each sheet passing adjacent the emitters. The gas wiping device of the drying assembly, mounted adjacent the emitters and such sheets, directs gas toward each such sheet to impact upon or scrub and further dry the sheet and the layer of ink thereon and cause the moisture and solvents arising from the sheet and layer of ink thereon to evaporate. The layer of ink applied to a sheet surface in the printing portion of each stand is dried by the drying assembly within the stand prior to the sheet passing from the stand.

The objects of the invention for a multi-stand, offset, sheet fed press are accomplished by a method of operating the apparatus to apply, in the printing portion of each stand, a layer of ink to the top surface of each sheet passing therethrough and anti-offset drying each such sheet and layer of ink thereon within such stand so that the sheet may be discharged from the press delivery end onto a stacking device and upon another without off-set or blocking. Each sheet passes adjacent a drying assembly mounted after and adjacent the printing portion of each stand. Radiant energy from emitters of such assembly and pressurized gas from a conduit thereof are directed toward the layer of ink on the top surface of each sheet to dry such ink layer thereon and cause the water vapor and solvents arising therefrom to evaporate. The drying in each stand of the layer of ink applied to a sheet in each stand results in the sheets being dried in a manner that permits them to be discharged from the press delivery end onto a stacking device, one upon another, without powder, and without off-set or blocking.

The term "anti-offset drying" as used herein with respect to a multi-stand sheet fed press in which a layer of ink is applied to the surfaces of sheets fed through the printing portion of each stand means the drying of the layers of ink on such sheets by a drying assembly mounted after and adjacent such printing portion within such stand prior to passage of the sheets through the remainder of the press and discharge from the delivery end one upon another, without the use of powders, onto a stacking device without offset or blocking.

The present invention further overcomes the problems and disadvantages associated with the use at the delivery end of a multi-stand, offset web printing press of substrate dryer/cooler apparatus positioned after the last printing stand to dry or cure the ink printed on the continuous substrate passing through such press stands before the substrate is fed through additional process equipment for further processing. More specifically the apparatus comprises an offset web press for printing a continuous substrate comprising: (A) a plurality of printing stands, each with a printing portion in which a layer of ink is applied to the substrate as it passes through each stand, and a drying assembly comprising a gas wiping device and emitter-cooler unit mounted after and adjacent each stand and adjacent the substrate passing rapidly therethrough; and (B) a delivery end, after the last printing stand, with additional process equipment.

BRIEF DESCRIPTION OF THE DRAWINGS

The nature of the invention will be more clearly understood by reference to the following description, the appended claims and the several views illustrated in the accompanying drawings.

DETAILED DESCRIPTION OF THE PREFERRED EMBODIMENTS

Figure 1:
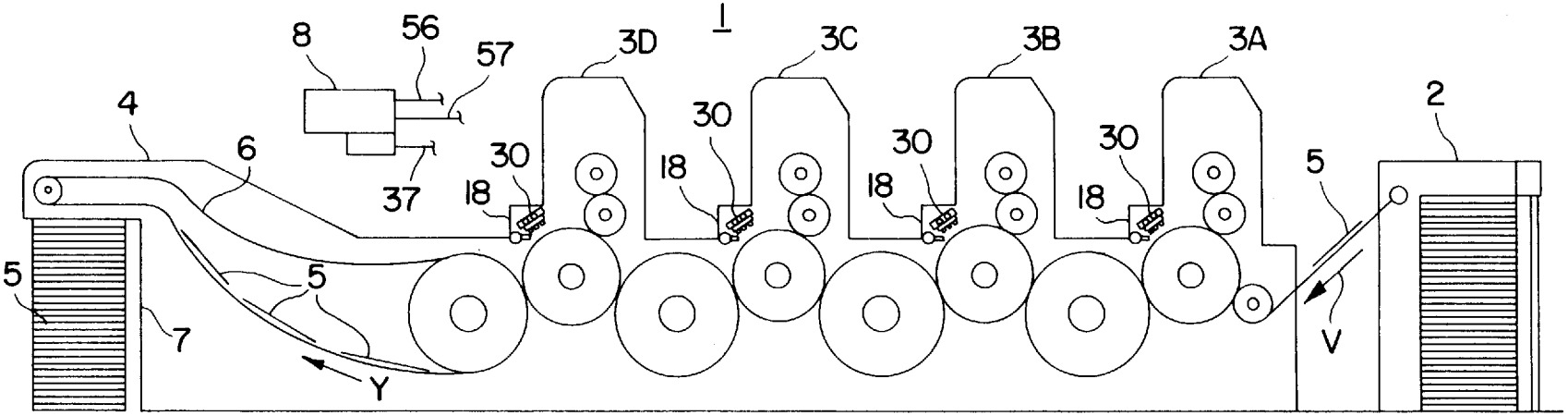
FIG. 1 is a schematic side view of a multi-stand, multicolor, sheet-fed offset press on which sheets are rapidly moved, printed, and dried, and, without the use of powders, stacked without sticking by means of the apparatus and method of the present invention.

Referring to FIG. 1 there is shown a multi-color, multi-stand offset printing press 1 capable of handling individual printed sheets having a width of up to 40 inches and traveling at a speed of approximately 500 feet per minute at a rate of 12,000 sheets per hour. Press 1 is of the type known as a Heidelberg CD press, manufactured by Heidelberger Druckmaschinen Aktiengesellschaft of Heidelberg, Germany. Press 1 includes feeder 2, printing stands 3A, 3B, 3C, and 3D, and delivery end 4. Individual sheets 5 move in direction V from feeder 2 through stands 3A, 3B, 3C, and 3D, respectively, on a feed path, not identified, to delivery end feed chain 6, moving in direction Y, which conveys sheets 5 through press delivery end 4 from which they are discharged, one on top of another, onto stacker 7. Pressurized dry, cool gas, preferably air, and liquid coolant, preferably water, is delivered to press 1 from cooling system 8.

Figure 3:
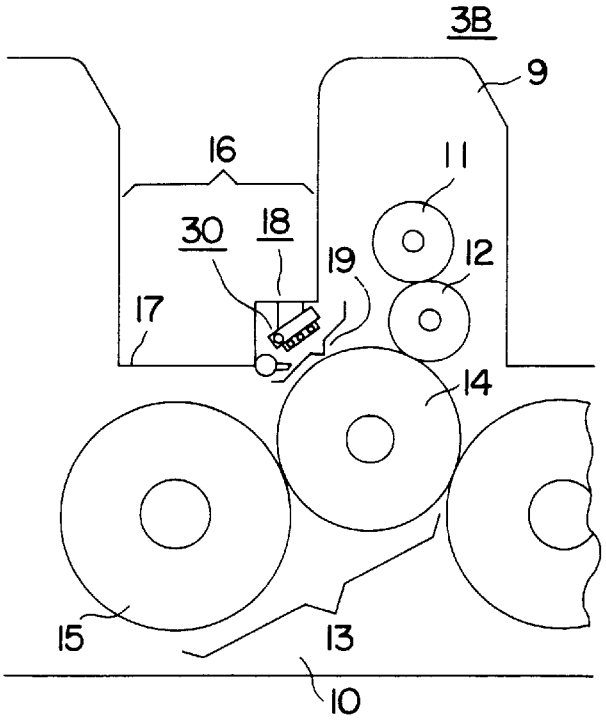
FIG. 3 is an enlarged view of one of the stands of the press of FIG. 1.
Figure 4:
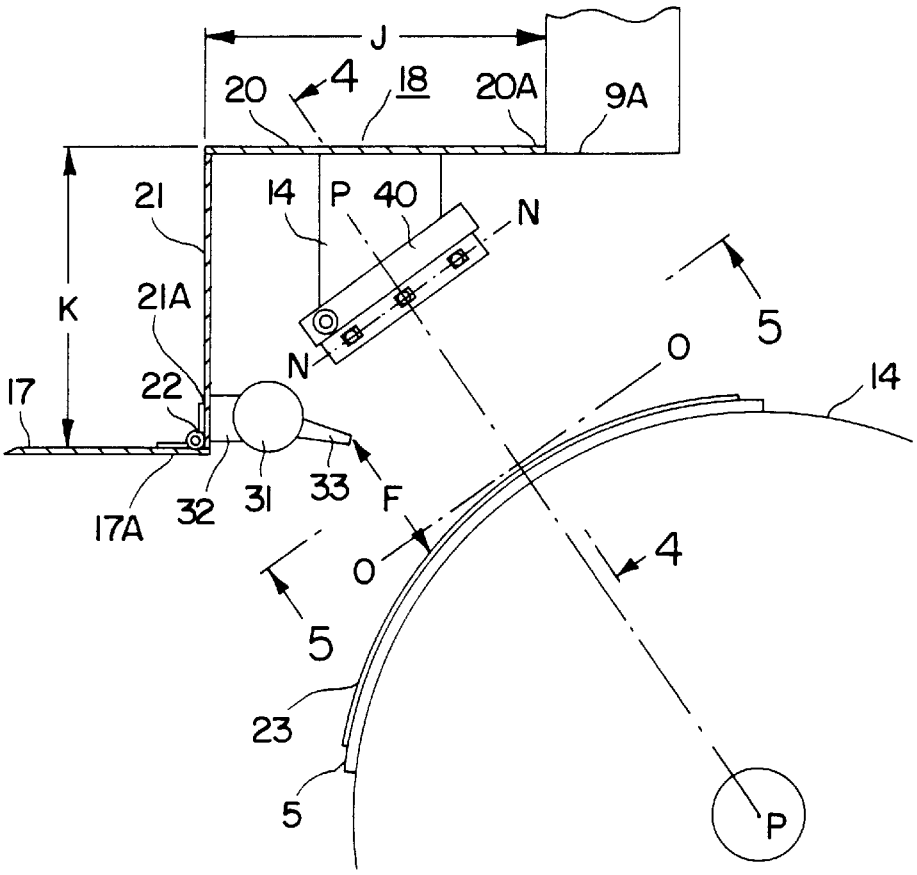
FIG. 4 is an enlarged end view of the drying assembly and adjacent parts of the stand of FIG. 3.

As best shown in FIGS. 3 and 4, printing stand 3B comprises upper printing portion 9, lower portion 10, plate cylinder 11, blanket cylinder 12, transfer assembly 13, that includes impression unit 14 and transfer unit 15, and interdeck portion 16, which includes deck plate 17 and housing 18, extending between printing portions 9 of stands 3B and 3C. Opening 19, defined by lower end 9A of the back side of upper printing portion 9 and the forward edge 17A of deck plate 17 provides access to the interior of printing stand lower portion 10 and the equipment therein. Interdeck housing 18, extends transversely of interdeck 16 across opening 19, and has top horizontal plate 20, having a width J, with inner edge 20A abutting printing portion lower end 9A, and vertical side plate 21, having a height K, movably connected at its lower end 21A by hinge 22 to deck plate forward edge 17A. Housing 18 also has closure plates at either end thereof, not shown. Mounted within interdeck housing 18 is drying assembly 30 which comprises gas conduit 31 and emitter-cooler unit 40. Gas conduit 31 and emitter-cooler unit 40 of drying assembly 30 extend transversely of stand 3B. Gas conduit 31 is mounted on the inside of housing side plate 21 by brackets 32, and emitter-cooler unit 40 is mounted on the underside of housing top plate 20 by brackets 41. Interdeck housing 18 and drying assembly 30, mounted thereon, can be moved easily into and out of operating position by pivoting housing 18 about hinge 22 for convenient access to the parts of assembly 30.

Figure 5:
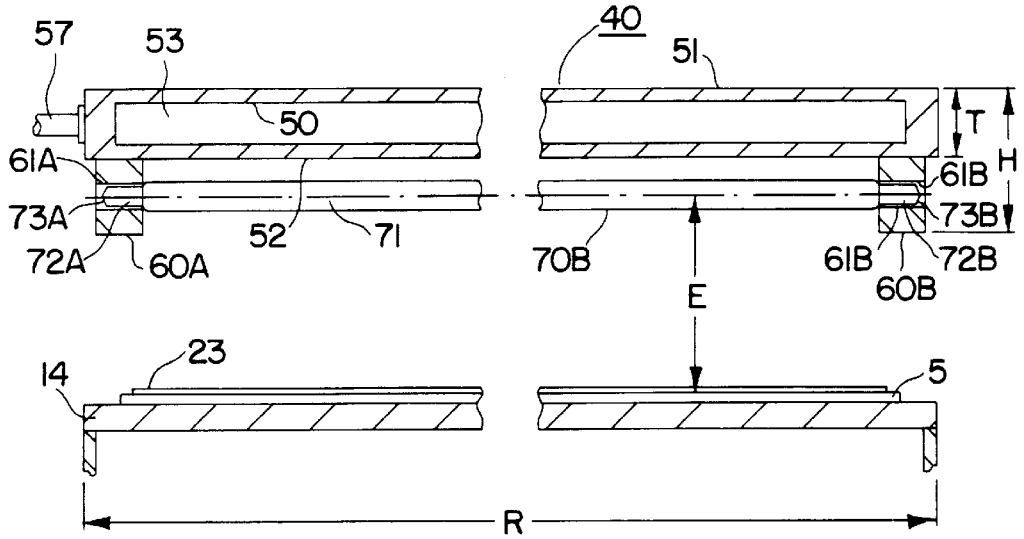
FIG. 5 is a cross-section of the drying assembly of FIG. 4 taken along the line 4—4 of FIG. 4.
Figure 6:
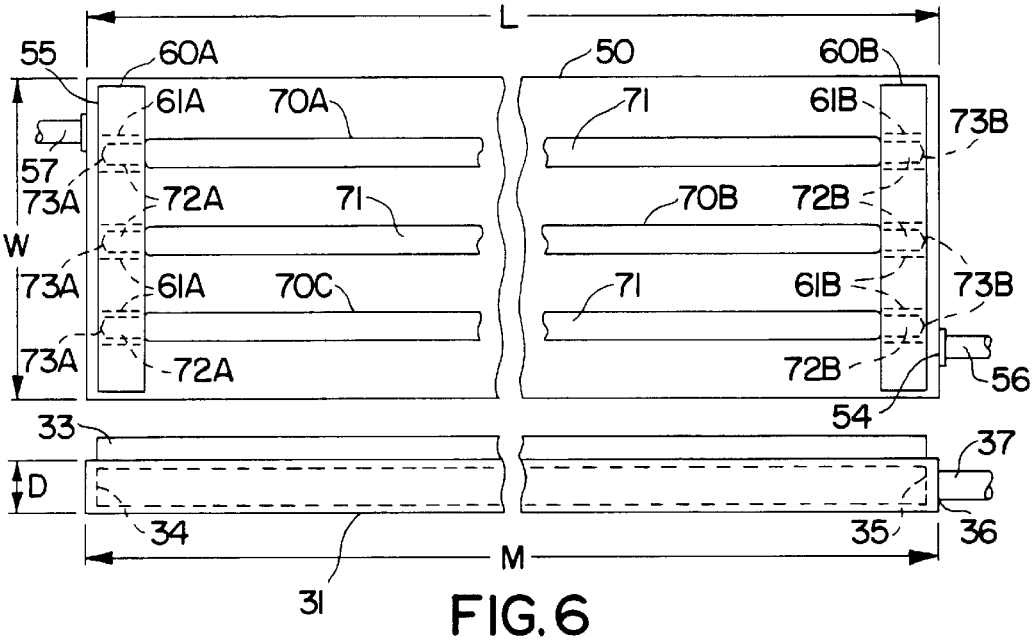
FIG. 6 is a bottom view of the drying assembly of FIG. 4 taken along the line 5—5 of FIG. 4.

As best shown in FIGS. 4, 5, and 6, gas conduit 31 is a hollow tube, having a diameter D and a length M. Conduit 31 has a cap 34 closing one end and a cap 35 closing the other end. Cap 35 has a port opening 36 therein, which connects with gas delivery duct 37 that extends to cooling system 8. Extending longitudinally of conduit 31 and projecting outwardly therefrom toward impression unit 14 is nozzle 33 having an opening therein, not shown.

Gas conduit 31 has a length M of forty inches, but may be between thirty-five and forty-five inches, depending upon the width of sheets 5 passing through press 1, and a diameter D of about two inches, but may be between three-quarters of an inch and three inches. Nozzle 33 extends longitudinally of conduit 31 and has an opening of about three-eighth inches extending the length thereof. Nozzle 33 is directed outwardly and downwardly from gas conduit 31 toward the layer of ink 23 on the top surface of sheet 5 carried on impression unit 14. The outer end of nozzle 33 is a distance F of about four inches from sheet 5 and the layer of ink 23 thereon, but may be at a distance between one and eight inches therefrom. Impression unit 14 has a length R of about forty-five inches.

Pressurized dry, cool gas, preferably air, at between forty to two hundred cubic feet per minute and at a temperature between 40° F. and 100° F. is delivered from cooling system 8 through gas delivery duct 37 to gas conduit 31 and discharged from the end of nozzle 33 toward printed sheet 5 and the layer of ink 23 thereon.

As best shown in FIGS. 4, 5, and 6, emitter-cooler unit 40 comprises cooler plate 50, end blocks 60A and 60B, and three emitters, 70A, 70B, and 70C. Cooler plate 50 has top 51, flat bottom 52, having a reflective surface, and coolant chamber 53. Plate 50 has a length L, width W and thickness T. Coolant chamber 53 has inlet opening 54 at one end thereof and outlet opening 55 at the opposite end thereof. Inlet opening 54 of chamber 53 is connected by liquid coolant feed tube 56 to cooling system 8, and outlet opening 55 of chamber 53 is connected by coolant return tube 57 to cooling system 8.

Emitter-cooler unit 40 has a height H of about two inches but may be between one and one-half and four inches. Cooler 50 has a length L of about forty inches, but may be between thirty-five and forty-five inches depending upon the width of sheets 5 passing through press 1. Cooler 50 has a width W of about six inches, but may be between two and ten inches. Cooler 50 has a thickness T of about nine sixteenth of an inch but may be between three-eighth and two inches. The distance E between plane N—N of emitters 70A, 70B, and 70C and sheet 5 and layer of ink 23 thereon is about three inches, but may be between one and eight inches.

Liquid coolant, preferably water, at a temperature of between 45° F. and 105° F. is delivered from cooling system 8 through liquid coolant feed tube 56 to chamber 53 of cooler plate 50. The temperature of the liquid coolant is raised as it passes through coolant plate chamber 53 due to the heat of the surrounding equipment, and the liquid passes therefrom and returns through return tube 57 to cooling system 8.

End blocks 60A and 60B are made of refractory insulating material and each extends transversely of one end of cooler plate flat bottom 52 and is fastened thereto in a manner known to those skilled in the art. Three openings 61A extend transversely through block 60A at spaced intervals of the length thereof, and three openings 61B extend transversely through block 60B at spaced intervals of the length thereof, with the center lines of openings 61A and 61B aligned. Openings 61A and 61B are equal in size. Emitters 70A, 70B, and 70C are loosely mounted in emitter-cooler unit 40, spaced from cooler plate bottom 52. Each emitter has a body portion 71, and metal end portions 72A and 72B, from which extend lead wires 73A and 73B, respectively, that form into a cable, in a manner known to those skilled in the art, and connect with a source of power, not shown. Each emitter end portion 72A extends into an opening 61A of block 60A and each emitter end portion 72B extends into an opening 61B of block 60B. Thus, emitter body portion 71 is supported between such blocks, generally parallel to cooler reflector bottom 52. Emitter 70A is parallel to emitter 70B and emitter 70B is parallel to emitter 70C and all lie in the same plane, N—N.

As best shown in FIGS. 4 and 5, emitters 70A, 70B, and 70C of emitter-cooler unit 40 are positioned to direct radiant energy upon the layer of ink 23 on the top surface of sheet 5, which is carried on sheet guiding surface, not identified, of impression unit 14 moving in direction Z. Each sheet 5 is held on unit 14 by clamping means, not shown, in a manner known to those skilled in the art. Plane N—N of emitter tubes 70A, 70B, and 70C is a distance E from the top surface of sheet 5 and layer of ink 23 thereon. Distance E is measured between plane N—N and a plane O—O which is perpendicular and tangent to sheet 5 and plane P—P extending between the longitudinal center line, not identified, of impression unit 14 and the longitudinal center line of emitter-cooler unit 40.

Emitters 70A, 70B, and 70C are of a filament type, 380 volts and 3 kilowatts, having a body 71 with a preferred diameter of about three-eighth of an inch, but the diameter may vary between three-eighth inch and one and three-eighth inches. The emitters utilize a filament that can generate radiant energy having a wavelength in the range of 0.4 micrometer to 4 micrometer, with radiant output determined by filament design and input power. Input power is regulated by suitable control means known to those skilled in the art. Emitters 70A, 70B, and 70C also may be of a non-filament arc design with emitted radiant energy having a wavelength in the range of 0.4 micrometer to 4 micrometer. The emitter of emitter cooler-unit 40 should substantially illuminate the surface of sheets 5 passing adjacent such unit.

In the preferred embodiment of the invention, emitter-cooler 40 includes three identical emitters 70A, 70B, and 70C. Output energy both in power and wave length can be adjusted to suit the requirements of each printed sheet. The requirements may vary depending upon pigment composition, solvent, substrate and production speed i.e. the dwell time of the sheets passing such emitters. The emitters of cooler unit 40 may be independently controlled and continuously adjusted to suit the specific application requirements. In all instances drying efficacy is maximized while cooler plate 50 and the gas discharged from conduit 31 act to cool the adjacent spaces and prevent heat damage to parts of the press. While the preferred embodiment of the invention has been described as having three identical emitters 70A, 70B, and 70C, each of such emitters may be different and have different characteristics to accommodate various types of inks, coatings and/or sheet material. It is also possible to vary the number and size of the emitters to accommodate variations in ink or coating, sheet material, equipment, and/or operation.

As shown in FIGS. 1 and 3, the apparatus, i.e. plate cylinder 11, blanket cylinder 12, transfer assembly 13 which includes impression unit 14 and transfer unit 15, and inter-deck housing 18 and drying assembly 30 mounted therein, of printing units 3A, 3C, and 3D, are identical to those of printing unit 3B described above.

Generally, in multi-stand printing presses of the prior art, which incorporate infra-red heating apparatus to dry inks printed on such sheets, the inks do not completely dry or cure before the sheets reach the sheet stacking devices positioned at the ends of the delivery end housings following such stands. To deal with the inability of inks on such sheets to adequately dry, anti-offset powders of generally small sizes are used to prevent off-set and/or blocking.

Figure 7:
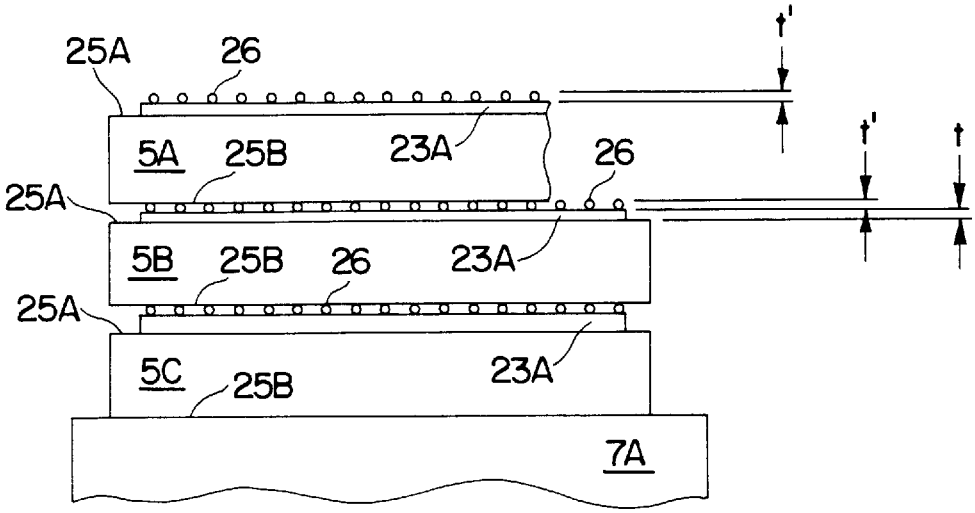
FIG. 7 is an exaggerated schematic cross-section of three ink coated sheets printed, dried in the manner of prior art infra-red drying apparatus, and treated with powders to prevent their sticking together when stacked.

As shown in FIG. 7, three sheets, 5A, 5B and 5C which have been discharged from a prior art press, that incorporates prior art infra-red drying apparatus, onto stacking device 7A, are stacked, one upon another. Each of sheets 5A, 5B, and 5C has a top surface 25A and a bottom surface 25B. A layer of ink 23A, having a thickness t, has been printed on top surface 25A of each of sheets 5A, 5B, and 5C. In such prior art presses the layers of ink applied to printed sheets do not adequately dry by the time they are discharged from the press delivery end housing onto stacker 7A. Thus, ahead of such stacker, it is necessary to spray a layer of anti-offset powders 26, having a thickness t', over the layer of ink 23A on the top surfaces of each of sheets 5A, 5B and 5C to act as separators and prevent the bottom surface 25B of sheet 5B from sticking to ink layer 23A on sheet 5C and the bottom surface 25B of sheet 5A from sticking to ink layer 23A on sheet 5B. Only a portion of such powders 26 contacts the layers of ink 23 and the remainder is deposited on press equipment and circulates through the press room causing a variety of problems.

Depending upon the material of sheets 5A, 5B and 5C, i.e. whether it is porous, such as fibrous paper or board, or very smooth and non-absorbent, such as plastic, the particles of anti-offset powders 26 stick above printed sheet surfaces 25A, forming projections which act to separate the sheet surfaces and, in some instances, feel gritty or sandy to the touch. Such sheets with powders thereon are not as pleasing in appearance as printed sheets with generally smooth surfaces. In addition, at times, the abrasive nature of such printed sheets causes further problems, particularly during shipment when such sheets have a tendency to rub together. The term "generally smooth" means smooth to the touch and without any foreign material on the surface, i.e. projecting above the surface as in the case of anti-offset powders. A professional press operator will readily observe that anti-offset dried sheets, which do not require use of anti-offset powders, using the apparatus and method of this invention have a more glossy appearance and greater color definition than sheets to which anti-offset powders have been applied. Furthermore such an operator, using a printer's glass, will observe that anti-offset dried sheets have virtually no surface imperfections as compared to sheets to which anti-offset powders have been applied.

Figure 8:
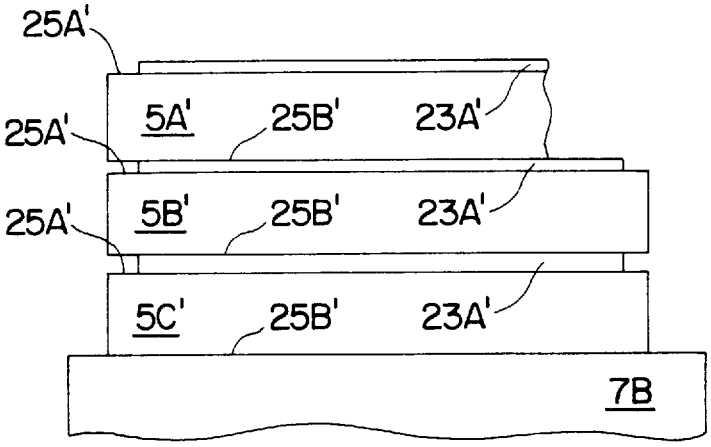
FIG. 8 is an exaggerated schematic cross-section of three ink coated sheets printed and dried by the apparatus and method of this invention and, without the use of powders, stacked without sticking.

As shown in FIG. 8, there are three sheets 5A', 5B', and 5C', each having a top surface 25A' and a bottom surface 25B'. A layer of ink 23A' has been printed on top surface 25A' of each of such sheets. Use of the apparatus of this invention results in the layer in ink 23A' being sufficiently dried when discharged from the press that, without the use of anti-offset powders, sheets 5A', 5B', and 5C' can be stacked one on top of another without off-set or blocking. The bottom 25B' of sheet 5B' is in direct contact with ink layer 23A' of sheet 5C' and bottom surface 25B' of sheet 5A' is in direct contact with ink layer 23A' of sheet 5B', without any off-set or blocking. Not only does the apparatus of this invention eliminate the requirement for use of anti-offset powders with resulting savings, but the top surfaces of the layers of ink 23A' are smooth to touch and appear smooth when observed.

Use of the apparatus of this invention enables operators of presses in existence to discontinue the application of anti-offset powders to sheets discharged from such presses, with resultant economies of operation. In new presses there is no requirement to incorporate a powder dispensing system and the capital investment for such a new press is lower than for a press incorporating such a system.

Figure 2:
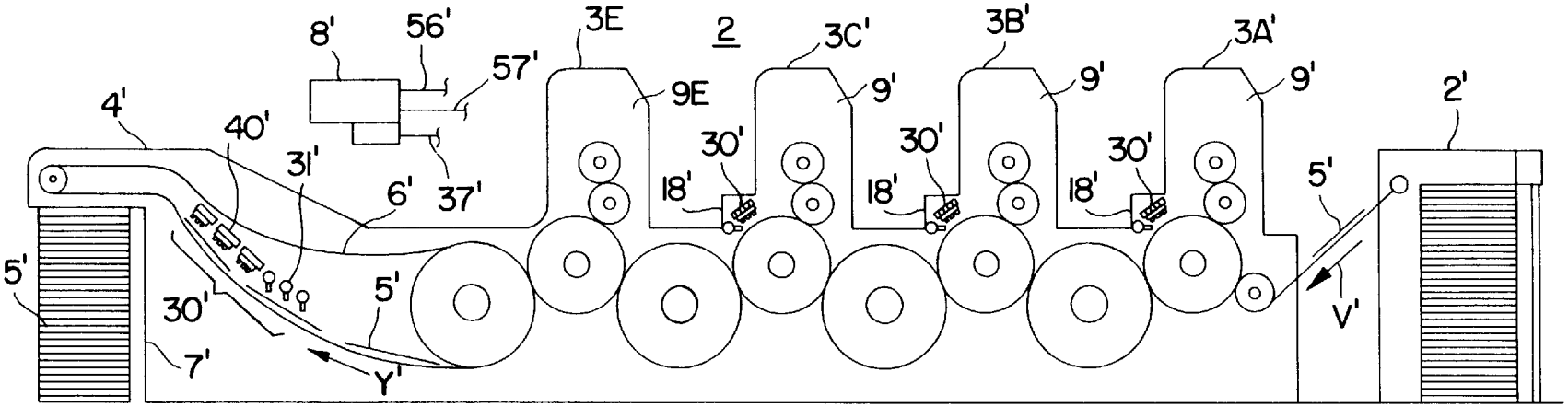
FIG. 2 is a schematic side view of a multi-stand, multicolor, sheet-fed offset press of a second embodiment on which sheets are rapidly moved, printed and dried, and, without the use of powders, stacked without sticking by means of the apparatus and method of the present invention.

At times, because of equipment design and operation, there is not as much space after and adjacent the upper printing portion of the last stand of a press to install a drying assembly and its housing as is the case with press 1 shown in FIG. 1, which has a drying assembly 30 and housing 18 after and adjacent printing portion 9 or stand 3D. When space after the last stand printing portion is at a premium, alternative equipment must be installed in a press to dry the layer of ink applied to the sheets in the printing portion of the last stand. In such a situation, it may be desirable to make use of the second embodiment of the equipment of this invention shown in FIG. 2. Press 1' comprises feeder 2', stands 3A', 3B', 3C' and 3E, and delivery end 4'. Individual sheets 5' move in direction V' from feeder 2' through such stands on a feed path, not identified, to delivery end feed chain 6' moving in direction Y', which conveys sheets 5' through delivery end 4' from which they are discharged, one on top of another, onto stacker 7'. Since there is a requirement to dry the ink layers printed on sheets 5' passing through the last stand 3E, an alternate type of drying assembly 30' is mounted a distance from such stand, between the flights of feed chain 6' of press delivery end 4'. Drying assembly 30' comprises a plurality of gas conduits 31' and emitter cooler units 40'. Dry, cool gas and liquid coolant is delivered to gas conduits 31' and emitter cooler units 40' of dryer assembly 30' from cooling system 8'. The gas conduits 31' and emitter-cooler units 40' of dryer assembly 30' operate in the same manner as those in drying assembly 30' of press stands 3A', 3B', and 3C', of press 1' and in the stands of press 1. The layers of ink printed on sheets 5' passing from stand 3E are dried by the radiant energy and dry, cool gas from drying assembly 30' mounted between the flights of feed chain 6 and the sheets are discharged from delivery end 4' onto stacker 7', one upon another, without off-set or blocking.

In another variation of the invention the method of operating the above described apparatus is accomplished in the following manner. Mechanically, as shown in FIG. 1, sheets 5 are delivered successively from feeder 2 through stands 3A, 3B, 3C, and 3D to feed chain 6 of delivery end 4 and discharged onto stacker 7 in the usual manner of multi-stand press operation. As shown in FIGS. 3, 4, 5, and 6 for stand 3B, as each sheet 5 is carried on impression unit 14 as it moves in direction Z into contact with blanket cylinder 12, a layer of ink 23 is applied to the sheet which then immediately passes adjacent and beneath emitters 70A, 70B, and 70C of emitter cooler unit 40 drying assembly 30 and nozzle 33 of gas conduit 31. Radiant energy from emitters 70A, 70B, and 70C and reflected from bottom 52 of cooler plate 50 of cooler unit 40 dries ink layer 23 on sheet 5 and pressurized cool gas directed from gas conduit nozzle 33 impacts upon, or scrubs, and further dries ink layer 23 and sheet 5 and evaporates water and solvents emitted therefrom. Cooler plate 50 of emitter-cooler 40 is cooled by liquid coolant from cooling system 8 circulated through coolant feed tube 56 to plate 50 and through chamber 53 therein and returned through return tube 57 to cooling system 8. Dry, cool gas from system 8 passes through gas delivery duct 37 to gas conduit 31 and is discharged from conduit nozzle 33 toward sheet 5 and ink layer 23 thereon. Cooling plate 50 and dry, cool gas discharged from gas conduit nozzle 33 maintain the space adjacent thereto and the nearby equipment of stand 3B at a lower operating temperature than would occur otherwise. Each sheet 5 with dried layer of ink 23 thereon passes on impression unit 14 to transfer unit 15 and then to impression unit 14 of the next succeeding stand 3C.

The cycle of printing and drying as described above for the method of this invention takes place in each of stands 3A, 3B, 3C, and 3D of press 1. The net result of the printing and drying is that the layer of ink 23 applied to each sheet 5 in the first stand, 3A, of press 1 is dried a first time by immediately being passed adjacent drying assembly 30 of stand 3A, after and adjacent printing portion 9. After sheet 5 with dried layer of ink 23 passes from stand 3A to stand 3B, a second layer of ink 23 is applied thereto. The second layer of ink 23 applied in stand 3B and the first layer of ink 23 applied in stand 3A are dried by the sheet immediately being passed beneath and adjacent dryer assembly 30 of stand 3B. After sheet 5 with the dried second and first layers of ink 23 thereon passes from stand 3B to stand 3C, a third layer of ink is applied thereto. The third, second, and first layers of ink 23 are dried by the sheet immediately being passed beneath and adjacent dryer assembly 30 of stand 3C. After sheet 5 with the dried third, second and first layers of ink 23 thereon passes from stand 3C to stand 3D, a fourth layer of ink 23 is applied thereto. The fourth, third, second, and first layers of ink 23 are dried by the sheet immediately being passed beneath and adjacent dryer assembly 30 of stand 3D. Thus, the first layer of ink 23 applied to sheet 5 in stand 3A is dried four separate items, i.e. in stands 3A, 3B, 3C, and 3D. The second layer of ink 23 applied to sheet 5 in stand 3B is dried three separate times, i.e. in stands 3B, 3C, and 3D. The third layer of ink 23 applied to sheet 5 in stand 3C is dried two separate times, i.e. in stands 3C and 3D. The fourth layer of ink 23 applied to sheet 5 in stand 3D is dried one time, i.e. in stand 3D.

In prior art printing operations in multi-stand presses in which first, second, third, and fourth layers of ink are applied successively, one on top of another in first, second, third, and fourth stands, respectively, without any intermittent drying, only the first layer of ink is applied to a dry sheet. In the method of operation of this invention, the first layer of ink is applied in stand 3A to a dry sheet from stacker 2. The layer of ink 23 applied to each of sheets 5 in stands 3B, 3C, and 3D, respectively, are applied to a surface previously dried in each of stands 3A, 3B, and 3C by exposure to the drying assembly 30 of each such stand. After leaving stand 3D, the dried sheets with layers of ink thereon are conveyed by feed chain 6 and discharged from the delivery end 4 onto stacker 7, one upon another, without off-set or blocking. The inks applied to sheets 5 progressing through press 1 are generally of different colors and are placed thereon in a sequence determined by press operation in a manner known to those skilled in the art.

The term "conventional ink" as used herein for offset presses and as known to those skilled in the art refers to non-ultraviolet inks. The basic chemistry of conventional ink includes solvents and pigments. The purpose of the apparatus and method of this invention is to drive the solvents from the ink as quickly as possible and set the ink into its dried condition as quickly as possible.

The terms "dry" or "drying" are relative terms. The drying of printed sheets from a press is effected by a number of factors, including quality of the sheet stock and the extent of absorption of the ink into the stock, the amount of water or solvent in the ink film, and the press environment. In printing press operations reference may be made to three types of drying: (1) drying by the use of anti-setoff powders, (2) anti-offset drying, and (3) total drying.

Drying by the use of anti-setoff powders refers to the action accomplished by spraying anti-offset powders onto the surfaces of sheets as they are discharged from the delivery end of a multi-stand, offset press in which the sheets, after being coated with a layer of ink in each of a number of printing stands, are exposed to infra-red drying apparatus. This type of apparatus merely heats the exposed portions of the ink layer, i.e. skin drying, with little or no adhesion of the ink layer to the sheet stock. The ink is wet to touching. The powder sprayed on the layer of ink creates or forms a space between the sheets sufficient to act as a separator and prevent offset or blocking when such sheets are stacked one upon another. However, while the use of anti-setoff powders permits sheets to be stacked one upon another without offset or blocking, the sheets are not dried adequately for prompt reworking. If the sheets are to be reworked, i.e. reprinted or sent to a bindery, the sheets must be dried for a minimum of thirty or forty minutes, but typically for as long as two hours, before such reworking can occur.

Anti-offset drying in the manner of this invention results in surface drying of the exposed portions of the ink layers combined with sufficient adhesion of such layers to the sheet stock to enable dried sheets to be stacked one upon another without offset or blocking. Anti-offset dried sheets are dry to touching and such dried sheets may be reworked in fifteen to twenty minutes, far less than the time required for sheets dried with the use of anti-offset powders. Total drying of an ink layer refers to drying which accomplishes total surface drying and adhesion of the ink coating to the substrate so that sheets dried in this manner are dry to touching and can be promptly reworked. In the printing industry total drying, generally, is accomplished only by use of ultra-violet inks and ultra-violet drying equipment.

While the preferred embodiments were described above with reference to a press capable of handling individual printed sheets having a width of approximately 40 inches, the apparatus of the invention may be designed for installation in presses handling wider or narrower sheets. The preferred embodiment of cooling plate 50 is made of aluminum but other superior heat sink materials, such as copper, may be used. The thickness and size of plate 50 may be varied depending upon the number of emitters, the size of such emitters and the degree of cooling to be accomplished. The term "plate" used in conjunction with cooler plate 50 includes for purposes of this invention, an extrusion, plate, or casting. It is also possible under certain conditions to use a curved cooler 50.

The apparatus of this invention described in connection with a multi-color, multi-stand sheet fed, offset printing press, which applies in each stand a layer of ink on the sheets fed through such press, effectively dries such sheets by means of a highly efficient compact drying assembly mounted in each of a plurality of such stands or at least a majority thereof, and extending transversely thereof. Each drying assembly comprises an emitter-cooler having a liquid cooled heat sink and at least one emitter, and a conduit for dry, cool gas. The conduit has a longitudinally extending nozzle. The compact drying assembly is mounted in each stand, or at least a majority of stands, after the printing portion thereof, in a housing which easily can be rotated into and out of operating position so that the parts of such assembly conveniently may be maintained. The liquid cooled heat sink and gas conduit of the drying assembly act to create a cool operating environment by reducing the operating temperatures of the equipment adjacent thereto while effectively drying the layer of ink applied in each stand to each sheet passing adjacent such drying assembly.

Figure 9:
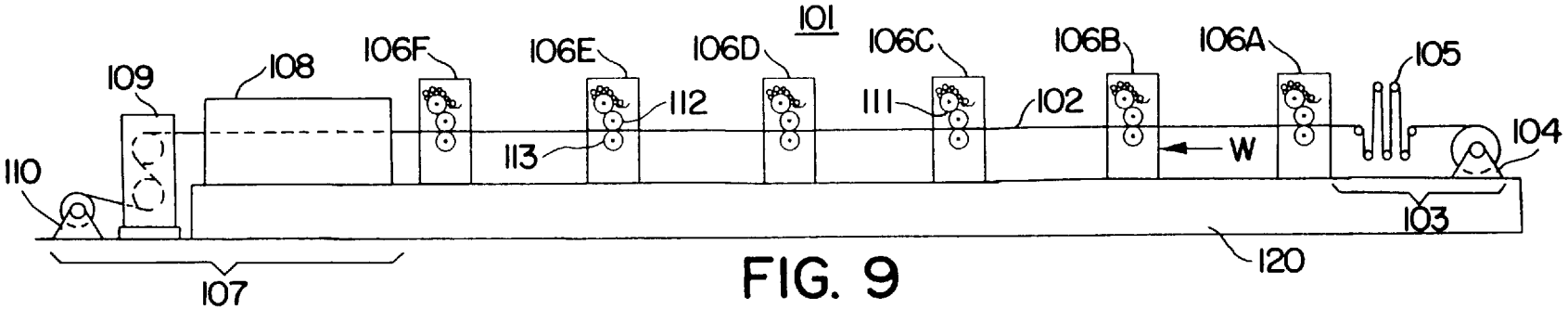
FIG. 9 PRIOR ART
FIG. 9 is a schematic side view of a prior art multi-stand, multi-color, offset web printing press on which a continuous substrate fed from a feed stand moves rapidly through the stands wherein ink is applied to the substrate top surface and then passed through dryer cooler apparatus after the last printing stand to dry and cool the substrate prior to further processing.

Another variation of the invention relates to multi-stand, multi-color, offset web printing presses wherein continuous substrate material is printed. Referring to FIG. 9 there is shown a multi-stand, multi-color, web printing press 101 of the prior art capable of handling a continuous substrate 102 having a width of between 38 to 40 inches and traveling at a speed of about 1200 feet per minute. Depending upon the size and characteristics of the web press, the substrate may have a width of between 10 and 60 inches and pass through the press at a speed of between 500 and 2000 feet per minute. Press 101 is of the type known as a Heidelberg-Harris offset web press manufactured by the Harris Company of the United States.

Press 101 comprises feed end 103, which includes feed stand 104 having a roll of continuous substrate 102 thereon, and tensioning apparatus 105, printing stands 106A, 106B, 106C, 106D, 106E, and 106F, and delivery end 107, which includes dryer 108, chill roll unit 109, and rewind stand 110. Continuous substrate 102 passes on a feed path, not identified, from feed stand 104, in the direction shown by arrow W, through tensioning apparatus 105, printing stands 106A–106F, dryer 108, chill roll unit 109 and is rewound onto a roll on rewind stand 110, or substrate 102 may be cut to size or folded in other processing equipment, not shown, that may be associated with delivery end 107.

Each of printing stands 106A–106F comprises printing portion 111 which includes blanket cylinder 112 and impression cylinder 113. As continuous substrate 102 moves through each of printing stands 106A, 106B, 106C, 106D, 106E, and 106F, respectively, ink from blanket cylinder 112 therein applies ink to the top surface of substrate 102. By virtue of the speed of operation of press 101, the ink applied in each of stands 106A–106F to the top surface of substrate 102 does not dry by the time it passes from last stand 106F. Consequently, substrate 102 moves through dryer 108, usually a large gas fired unit, that maintains a temperature of about 260° F. to dry the ink on substrate 102. The heated substrate then passes through chill roll unit 109, normally operated at a temperature of between about 45° F. to 50° F., to lower the temperature of substrate 102, and then to rewind stand 110 on which substrate 102 is rewound into a roll or further processed. In prior art web presses of the type described above, the cost of the dryer and required catalytic and other environmental equipment and the chill roll unit significantly increases the capital investment for web presses and their operating costs add a considerable amount to the cost of press operation.

Figure 10:
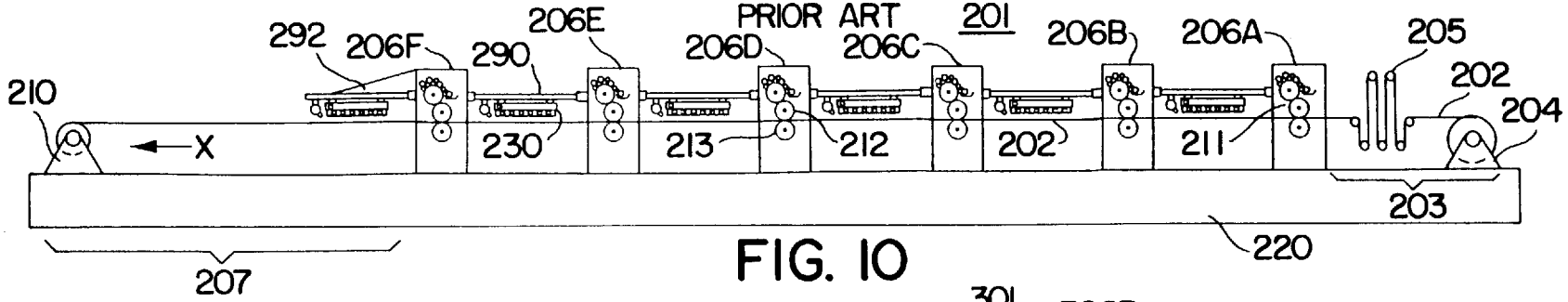
FIG. 10 is a schematic side view of a multi-stand, multi-color, offset web printing press on which a continuous substrate fed from a feed stand moves rapidly through each stand wherein ink is applied to the substrate top surface and then dried by a drying assembly following adjacent each stand by means of the apparatus and method of the present invention so that following the last printing stand drying assembly the substrate is ready for further processing.

The apparatus and method of the present invention may be adapted to web presses to eliminate the requirement for delivery end drying and cooling equipment for such presses while producing printed substrates of equal quality. Referring to FIG. 10 there is shown multi-stand, multi-color, web press 201 comprising feed end 203, which includes feed stand 204 having substrate 202, in roll form, mounted thereon, and tensioning apparatus 205, printing stands 206A, 206B, 206C, 206D, 206E, and 206F, and delivery end 207, which includes rewind stand 210. Substrate 202 passes on a feed path, not identified, from feed stand 204, in the direction shown by arrow X, through tensioning apparatus 205, printing stands 206A–206F and is rewound into a roll on rewind stand 210. Each of printing stands 206A–206F comprises printing portion 211, which includes blanket cylinder 212 and impression cylinder 213. As substrate 202 moves through each of printing stands 206A, 206B, 206C, 206D, 206E, and 206F, ink from blanket cylinder 212 is applied to the top surface of substrate 202. With the exception of dryer 108 and chill roll unit 109 of delivery end 107 of the prior art web press 101 shown in FIG. 9, press 201 of FIG. 10 is substantially the same as press 101. However, press 201 makes use of different apparatus and method for drying inks applied in print stands 206A–206F on the top surface of substrate 202 and does not require a large dryer and chill roll unit after last stand 206F.

Figure 11:
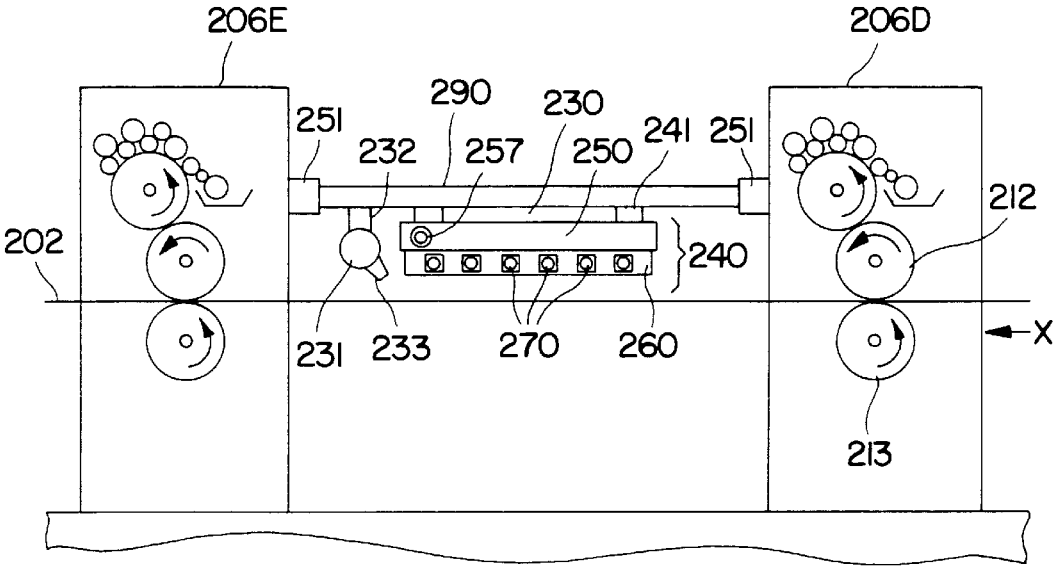
FIG. 11 is an enlarged fragmentary view of FIG. 10 showing the apparatus of the invention in greater detail between two stands of a multi-stand, offset web press in which ink is applied to the top surface of the substrate moving rapidly between the stands and then dried by a drying assembly following and adjacent each stand and the substrate top surface.

As best shown in FIGS. 10 and 11, a drying assembly 230 is mounted after and adjacent each of printing stands 206A, 206B, 206C, 206D, 206E, and 206F and adjacent top surface of substrate 202. Each drying assembly 230 comprises gas conduit 231 and emitter cooler unit 240 which, as parts of such assembly, extend transversely of substrate 202. Each drying assembly 230 is supported by mounting bracket 290, which is fastened by end brackets 251 between stands 206A and 206B, 206B and 206C, 206C and 206D, 206D and 206E, and 206E and 206F. Mounting bracket 290 supporting drying assembly 230 after stand 206F is secured thereto by cantilevered arm 292. In each drying assembly 230, gas conduit 231 is secured by clip 232 to mounting bracket 290 and emitter-cooler unit 240 is secured thereto by clips 241. Mounting brackets 290 extend parallel to substrate 202.

Drying assemblies 230 and the parts thereof of press 201 are, except for size, substantially similar in design and operation to drying assemblies 30 of sheet press 1 described above and shown in FIGS. 1, 3, 4, 5, and 6. As best shown in FIG. 11, gas conduit 231 is a hollow tube extending transversely of substrate 202 and connecting with a gas delivery duct, not shown, that extends to a cooling system not shown. Extending longitudinally of gas conduit 231 and projecting outwardly and downwardly therefrom toward substrate 202 is nozzle 233 having an opening therein, not shown. The outer end of nozzle 233 is spaced about two inches from the top surface of substrate 202 and the ink thereon but may be at a distance of between one and six inches therefrom. Pressurized dry, cool gas, preferably air, is discharged from the end of nozzle 233 toward the top surface of substrate 202 and the layer of ink thereon.

As best shown in FIG. 11, emitter-cooler unit 240 comprises cooler plate 250, end blocks 260 and six spaced emitters 270. Coolant return tube 257 and coolant feed tube, not shown, at the opposite end of cooler plate 250, connect plate 250 to a cooling system, not identified, for the circulation of cooling liquid through plate 250. The distances between a plane, not shown, through the longitudinal centerlines of emitter 270 and the top surface of substrate 202 is about two inches, but may be between one and six inches. The emitters 270 of emitter-cooler unit 240 substantially illuminate the top surface of substrate 202 and the ink thereon passing beneath and adjacent thereto.

As mentioned above, the drying assembly 230 of web press 201 and the parts thereof and the cooling system, not shown, associated therewith are, except for size, substantially similar in design, and operation to drying assemblies 30 of sheet press 1 described above. The size of drying assemblies 230 is larger, for example there are six emitters 270 in emitter-cooler 240 of drying assemblies 230 of web press 201 as compared to three emitters 70 in emitter cooler unit 40 of sheet press 1, due to the fact that substrate 202 of web press 201 travels at a substantially higher speed than do sheets 5 passing through sheet press 1. Thus, more radiant energy must be directed toward the ink on substrate 202 of web press 201 than toward the ink on sheets 5 of sheet press 1.

The method of operation of web press 201 incorporating the apparatus of this invention is accomplished in the following manner. Substrate 202 in roll form is unwound from feed stand 204, passes in the direction shown by arrow X through tensioning apparatus 205 and through printing stands 206A–206F, respectively, to delivery end 207 where substrate 202 is rewound into roll form on rewind stand 210. As substrate 202 passes through each of stands 206A–206F, a layer of ink from blanket cylinder 212 of printing portion 211 is applied to the top surface of substrate 202. Ink coated substrate 202 then passes beneath emitters 270 and nozzle 233 of gas conduit 231 of drying unit 230 following and adjacent each such stand. Radiant energy from emitters 270 dries the ink layer on top surface of substrate 202 and pressurized gas directed from gas conduit nozzle 233 impacts upon, or scrubs, and further dries such ink layer on substrate 202 and evaporates water and solvents emitted therefrom. Cooling plate 250 of emitter cooler unit 240 and dry cool gas discharged from gas conduit nozzle 233 maintain the space adjacent thereto and nearby equipment at a lower operating temperature than would occur otherwise.

The cycle of printing and drying as described above for the method of this invention for a web press takes place in conjunction with each of stands 206A, 206B, 206C, 206D, 206E, and 206F. The net result of the printing and drying is that the layer of ink applied to the top surface of substrate 202 in first stand 206A of web press 201 is dried a first time by immediately being passed adjacent drying assembly 230 after and adjacent printing portion 211 thereof. After substrate 202 with dried ink on the top surface thereof passes to second stand 206B and thereafter to third stand 206C, fourth stand 206D, fifth stand 206E, and sixth stand 206F, respectively, a layer of ink is applied in each such stand to the top surface of substrate 202. The drying assembly 230 after and adjacent each of such stands and printing portions 211 thereof dry the ink applied by each of such stand printing portion 211 on the top surface of substrate 202. Thus, the ink layer applied to the top surface of substrate 202 in each of printing stands 206A–206F is dried after and adjacent each stand. This compares to the operation of the prior art web press 101 wherein a separate layer of ink is applied to the top surface of substrate 102 in each of printing stands 106A–106F and the composite layers are dried in dryer 108 upon substrate 102 after the last stand 106F. Due to the heat imparted to substrate 102 while passing through dryer 108, substrate 102 must be passed through chill roll unit 109 to lower the temperature thereof prior to being rewound on rewind stand 110.

Figure 12:
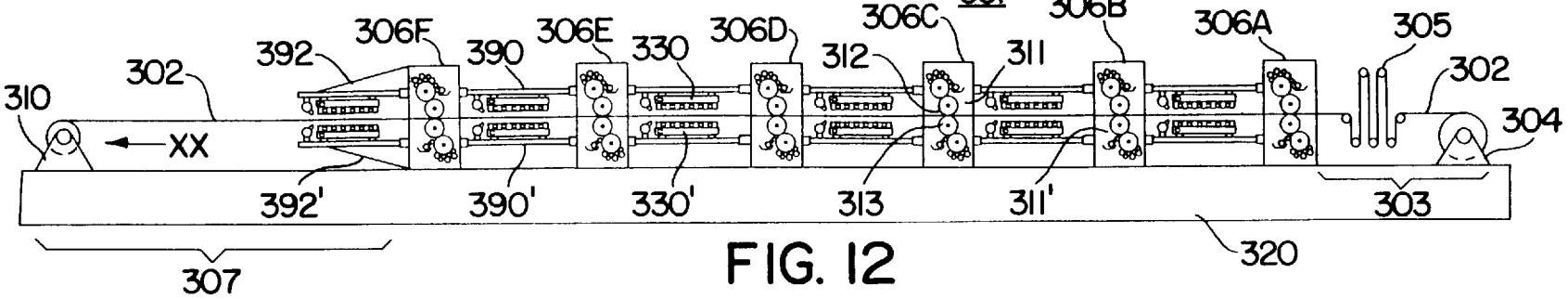
FIG. 12 is a schematic side view of a multi-stand, multi-color, offset web printing press on which a continuous substrate fed from a feed stand moves rapidly through each printing stand wherein ink is applied to the substrate top and bottom surface and then dried by a drying assembly, above and below the substrate, following and adjacent each stand by means of the apparatus and method of the present invention so that following the last printing stand drying assembly the substrate is ready for further processing.

Another variation of the invention as it relates to multi-stand, multi-color, offset web printing presses is shown in FIG. 12. Referring to FIG. 12 there is shown multi-stand, multi-color, web press 301 comprising feed end 303, which includes feed stand 304 having substrate 307 in roll form mounted thereon and tensioning apparatus 305, printing stands 306A, 306B, 306C, 306D, 306E, and 306F, and delivery end 307 which includes rewind stand 310. Substrate 302 passes on a feed path, not identified, from feed stand 304 in the direction shown by arrow XX through tensioning apparatus 305, printing stands 306A, 306B, 306C, 306D, 306E, and 306F and is rewound into a roll on rewind stand 310. Each of printing stands 306A–306F comprises top printing portion 311, which includes blanket cylinder 312 and bottom printing portion 311' which includes blanket cylinder 311'. As substrate 302 moves through each of printing stands 306A, 306B, 306C, 306D, 306E, and 306F, respectively, ink from blanket cylinder 312, in each such stand, is applied to the top surface of substrate 302 and ink from blanket cylinder 312' in each such stand is applied to the bottom surface of substrate 302.

Figure 13:
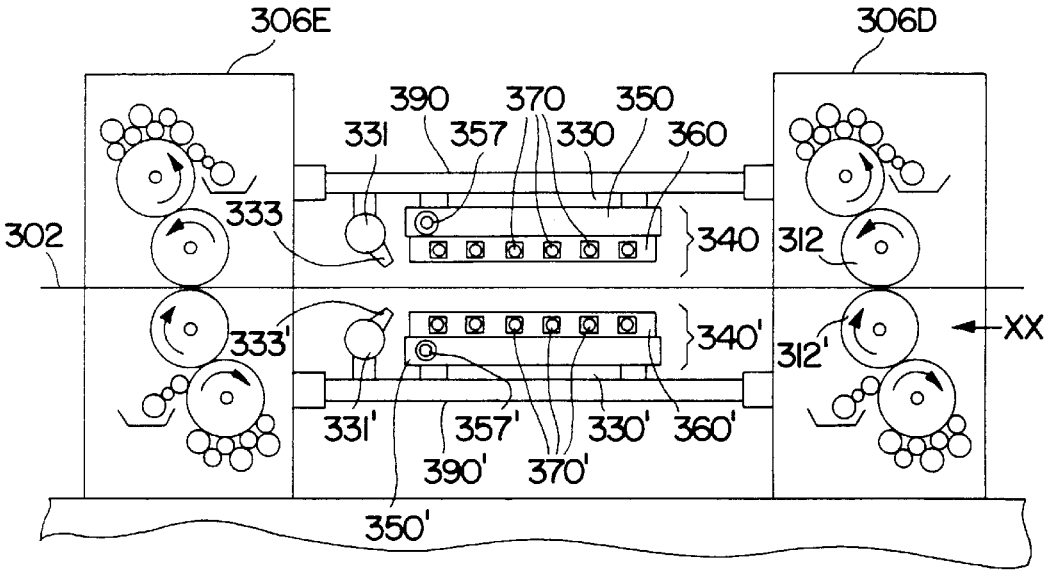
FIG. 13 is an enlarged fragmentary view of FIG. 12 showing the apparatus of the present invention in greater detail between two stands of a multi-stand, offset web press in which ink is applied to the top and bottom surface of the substrate moving rapidly between the stands and then dried by drying assemblies, one above and one below the substrate, following and adjacent each stand and the substrate top and bottom surfaces.

As best shown in FIGS. 12 and 13, drying assembly 330 is mounted after and adjacent top printing portion 311 of each of printing stands 306A–306F and adjacent top surface of substrate 302, and drying assembly 330' is mounted after and adjacent bottom printing portion 311' of each of printing stands 306A–306F and adjacent bottom surface of substrate 302. Each drying assembly 330 is supported above substrate 302 by mounting bracket 390 which is fastened by end brackets between stands 306A–306B, 306B–306C, 306C–306D, 306D–306E, and 306E–306F. Mounting bracket 390 supporting drying assembly 330 above substrate 302 after stand 306F is secured thereto by cantilevered arm 392. Each drying assembly 330' is supported beneath substrate 302 by mounting bracket 390' which is fastened by end brackets between stands 306A–306B, 306B–306C, 306C–306D, 306D–306E, and 306E–306F. Mounting bracket 390' supporting drying assembly 330' beneath substrate 302 after stand 306F is secured thereto by cantilevered arm 392'.

Drying assemblies 330 and 330' and the parts thereof of press 301 are substantially identical to drying assembly 230 and the parts thereof of press 201. That is the parts of emitter cooler 240, comprising cooler plate 250, end blocks 260, and emitters 270, are substantially identical to the parts of emitter cooler 340, comprising cooler plate 350, end blocks 360 and emitters 370, and the parts of emitter cooler 340' comprising cooler plate 350', end blocks 360' and emitter 370'. In similar fashion gas conduit 231 and end nozzle 233 of drying assembly 230 and gas conduit 331 and end nozzle 333 and gas conduit 331' and end nozzle 333' of drying assembly 330' are substantially identical.

Press 301 top printing portion 311 and bottom printing portion 311' are substantially similar in design and operation except that they operate on opposite sides of substrate 302. Top printing portion 311 and bottom printing portion 311' are substantially similar in design and operation to printing portion 211 of press 201 except for impression cylinder 213 included in printing portion 211 because press 201 applies ink only to the top surface of substrate 202.

The apparatus of this invention and its method of operation have been described above with respect to embodiments shown in FIGS. 1, 2, and 9. In the embodiment shown in FIG. 1, a drying assembly 30 is mounted in each of four stands 3A, 3B, 3C, and 3D adjacent printing portions 9 of a four stand offset, sheet fed press 1. In the embodiment shown in FIG. 2, a drying assembly 30' is mounted in each of three stands, 3A', 3B', and 3C' adjacent printing portions 9 of four stand offset, sheet fed press 1', which also includes a drying assembly 30' mounted after stand 3E in press delivery end 4'. In the embodiment shown in FIG. 9, a drying assembly 230 is mounted after and adjacent the printing portion 111 of each of six stands 106A, 106B, 106C, 106D, 106E, and 106F of a six stand offset web press for printing a continuous substrate.

The improved apparatus of the invention and its method of operation are equally applicable to any multi-stand offset press for printing either sheets, i.e. a discontinuous substrate of a uniform or non-uniform size, or a web, i.e. a continuous substrate in two or more stands in which a drying assembly is mounted after and adjacent the printing portion of the first stand and a second drying assembly is mounted after and adjacent the printing portion of a subsequent stand or in the delivery end of the press.

I claim:

1. Apparatus for printing and drying a continuous substrate fed along a feed path through a plurality of stands to the end of the feed path, the apparatus comprising:

(A) a printing portion in a plurality of said stands, each printing portion capable of applying an ink layer to a surface of said substrate, (B) a drying assembly mounted after and adjacent the printing portions of a plurality of said stands, each drying assembly comprising (1) emitter means for radiating energy toward said substrate surface and layer of ink thereon, and (2) a gas conduit positioned adjacent the emitter means for directing a flow of cool gas onto said substrate surface and layer of ink thereon, the cool gas being at a temperature lower than the operating temperature of the adjacent printing portion, the energy from the emitter and flow of cool gas from the gas conduit serving to dry the substrate surface and layer of ink thereon passing adjacent each said drying assembly prior to the end of the feed path.

2. Apparatus of claim 1 wherein the drying assembly further comprises a reflective surface adjacent the emitter means.

3. Apparatus of claim 1 wherein the drying assembly further comprises cooling means for the emitter means.

4. Apparatus of claim 1 wherein there are at least four stands having a printing portion therein and there is a drying assembly mounted after and adjacent at least three of the printing portions thereof.

5. The apparatus of claim 1 wherein the emitter means generates radiant energy having a wavelength in the range of 0.4 micrometer to 4 micrometer.

6. Apparatus for drying a continuous substrate passing along a feed path through a plurality of printing stands of an offset web press to the end thereof, each stand having a printing portion for applying a layer of ink to a surface of the substrate, the apparatus comprising:

a drying assembly mounted after and adjacent at least a portion of the plurality of stands, said drying assembly serving to dry the surface of the substrate and the layer of ink thereon and comprising (1) emitter means for radiating energy toward the substrate surface and layer of ink thereon, and (2) a gas conduit positioned adjacent the emitter means for directing a flow of cool gas onto said substrate and layer of ink thereon, the cool gas being at a temperature lower than the operating temperature of the adjacent printing portion.

7. The apparatus of claim 6 wherein the emitter means generates radiant energy having a wavelength in the range of 0.4 micrometer to 4 micrometer.

8. The apparatus of claim 6 wherein the drying assembly emitter means and drying assembly gas conduit are each connected to cooling means for cooling the emitter and for cooling the gas flow into the conduit.

9. Apparatus for drying a continuous substrate passing on a feed path through a plurality of stands of an offset web press to the end thereof, each stand having a printing portion for applying a layer of ink to the top surface of the substrate and a printing portion for applying a layer of ink to the bottom surface of the substrate, the apparatus comprising:

(A) a top drying assembly mounted after and adjacent at least a portion of the printing portions, the top drying assembly comprising (1) top emitter means for radiating energy toward the substrate top surface and layer of ink thereon, and (2) a top gas conduit for directing a flow of cool gas onto the substrate top surface and layer of ink thereon, the cool gas being at a temperature lower than the operating temperature of the adjacent printing portion, and (B) a bottom drying assembly mounted after and adjacent at least a portion of the printing portions, the bottom drying assembly comprising (1) bottom emitter means for radiating energy toward the substrate bottom surface and layer of ink thereon, and (2) a bottom gas conduit for directing a flow of cool gas onto the substrate bottom surface and layer of ink thereon, the cool gas being at a temperature lower than the operating temperature of the adjacent printing portion.

10. The apparatus of claim 9 wherein the emitter means generates radiant energy having a wavelength in the range of 0.4 micrometer to 4 micrometer.

11. The apparatus of claim 9 wherein the drying assembly emitter means and drying assembly gas conduit are each connected to cooling means for cooling the emitter and for cooling the gas flow into the conduit.

12. A method of printing, in an offset web press, a continuous substrate, the method comprising the steps of:

(A) passing the substrate from a feeding device along a feed path through the plurality of stands toward the press end, (B) applying in the printing portion of each stand a first layer of ink to the top substrate surface and a second layer of ink to the bottom substrate surface, (C) passing each substrate surface and layer of ink thereon past a radiant energy emitter after and adjacent the application of ink thereto in a plurality of the printing portions of the stands, (D) passing each substrate surface and layer of ink thereon past a cool gas flow adjacent each radiant energy emitter, the cool gas being at a temperature lower than the operating temperature of the adjacent printing portion, the combination of radiant energy from each emitter and adjacent cool gas flow drying the substrate top and bottom surfaces and the ink layers thereon after each stand, (E) directing the substrate and dried layers of ink on the top and bottom surface thereof after the last stand to the press end.

13. A method of printing, in an offset web press, a continuous substrate passing from a feeding device along a feed path through a plurality of stands, each having a printing portion therein, to the end thereof, the method comprising the steps of:

(A) passing the substrate from the feeding device along the feed path through the plurality of stands toward the press end, (B) applying in the printing portion of each stand a layer of ink to one surface of the substrate, (C) passing the substrate and layer of ink on the surface thereof past a radiant energy emitter after and adjacent the application of each layer of ink to the surface of the substrate in at least half the stand printing portions, and (D) passing the substrate and layer of ink on the surface thereof past a cool gas flow adjacent each radiant energy emitter, the cool gas being at a temperature lower than the operating temperature of the adjacent printing portion, the combination of radiant energy from each emitter and adjacent gas flow drying the substrate surface and layer of ink thereon, and (E) directing the substrate and layers of ink dried on its surface thereof after the last stand to the press end.

14. A method of printing, in an offset web press, a continuous substrate passing from a feeding device at one end along a feed path to the press end, the method comprising the steps of:

(A) passing the substrate from the feeding device along the feed path through a first stand having a printing portion therein, (B) applying a first layer of ink to a first surface of the substrate, (C) passing the substrate and first layer of ink on the first surface thereof past a first energy emitter adjacent the application of the first layer of ink thereon, (D) passing the substrate and first layer of ink on the first surface thereof past a first cool gas flow adjacent the first energy emitter, the first cool gas flow being substantially at a temperature between about 40° F. and 100° F. and substantially at a rate of between about 40 to 200 cubic feet per minute, the combination of the first emitter radiant energy and first cool gas flow drying the substrate surface and first layer of ink thereon, (E) passing the substrate and first layer of ink on the first surface thereof along the feed path through a second stand having a printing portion therein, (F) applying a second layer of ink to the first surface of the substrate, (G) passing the substrate and first and second layers of ink on the first surface thereof past a second radiant energy emitter adjacent the application of the second layer of ink thereon, (H) passing the substrate and first and second layers of ink on the first surface thereof past a second cool gas flow adjacent the second radiant energy emitter, the second cool gas flow being substantially at a temperature between about 40° F. and 100° F. and substantially at a rate of between about 40 to 200 cubic feet per minute, the combination of the second radiant emitter and second cool gas flow drying the substrate surface and second layer of ink thereon, and (I) passing the substrate and dried first and second layers of ink applied to the first surface thereof along the feed path toward the press end.

15. A method of printing, in an offset web press, a continuous substrate passing from a feeding device along a feed path to the press end, the method comprising the steps of:

(A) passing the substrate from the feeding device along the feed path through a plurality of printing stands each having a printing portion therein, (B) applying, in the printing portion of each printing stand, a layer of ink to a surface of the substrate passing therethrough, (C) passing the substrate and layer of ink applied to the surface thereof in each stand printing portion past a radiant energy emitter after and adjacent the ink application, (D) passing the substrate and layer of ink applied to the surface thereof in each stand printing portion past a cool gas flow after and adjacent the radiant energy emitter, the cool gas flow being substantially at a temperature between about 40° F. and 100° F. and substantially at a rate of between about 40 to 200 cubic feet per minute, the combination, after each stand, of the emitter radiant energy and cool gas flow drying the substrate and layer of ink applied to the surface thereof in each stand, and (E) passing to the press end the substrate having the applied and dried layers of ink thereon.

* * * * *